US007727034B1

(12) United States Patent
Liu et al.

(10) Patent No.: US 7,727,034 B1
(45) Date of Patent: Jun. 1, 2010

(54) CONNECTOR FOR CONNECTING PRINTED SURFACE AREA OR LINE WITH CONDUCTIVE WIRE

(76) Inventors: Lisong Liu, 1152 Casa Marcia Pl., Fremont, CA (US) 94539; Jessica S. Liu, 1152 Casa Marcia Pl., Fremont, CA (US) 94539

( * ) Notice: Subject to any disclaimer, the term of this patent is extended or adjusted under 35 U.S.C. 154(b) by 0 days.

(21) Appl. No.: 12/470,784

(22) Filed: May 22, 2009

(51) Int. Cl.
*H01R 4/02* (2006.01)

(52) U.S. Cl. ..... 439/874

(58) Field of Classification Search ..... 439/874, 439/876, 83

See application file for complete search history.

(56) References Cited

U.S. PATENT DOCUMENTS 2,118,148 A * 5/1938 Bone ..... 174/75 B
2,135,741 A * 11/1938 Bone ..... 174/75 B
2,146,462 A * 2/1939 Bone ..... 174/75 B
2,719,956 A * 10/1955 Leighton ..... 439/278
2,973,404 A * 2/1961 Anderson ..... 174/87
3,076,113 A * 1/1963 Candelise ..... 313/135
3,176,261 A * 3/1965 Greco et al. ..... 439/637
3,179,913 A * 4/1965 Mittler et al. ..... 439/48
3,212,049 A * 10/1965 Mittler et al. ..... 439/45
3,789,349 A * 1/1974 Scott ..... 439/736
3,875,324 A 4/1975 Waddington et al.
4,118,097 A * 10/1978 Budnick ..... 439/387
4,155,614 A * 5/1979 Hall ..... 439/278
4,165,726 A * 8/1979 Helmer, Jr. ..... 123/146.5 A
4,204,741 A * 5/1980 Hall ..... 439/278
4,259,543 A * 3/1981 Oldham ..... 174/70 S
4,338,895 A * 7/1982 Lennis et al. ..... 123/146.5 A
4,399,602 A * 8/1983 Hancock et al. ..... 29/426.4
4,566,746 A * 1/1986 Hobson ..... 439/588
4,631,372 A * 12/1986 Kronberger ..... 200/19.39
4,639,560 A * 1/1987 Kronberger ..... 200/19.38
4,648,677 A * 3/1987 Lang ..... 439/404
4,661,661 A * 4/1987 Kronberger ..... 200/19.39
4,801,269 A * 1/1989 Howard et al. ..... 439/63
4,828,503 A * 5/1989 Gilissen et al. ..... 439/62
4,838,808 A * 6/1989 Fujiura ..... 439/357
4,894,023 A * 1/1990 Hall ..... 439/278
4,898,173 A * 2/1990 Daglow et al. ..... 607/37
4,934,367 A * 6/1990 Daglow et al. ..... 439/527
5,070,605 A * 12/1991 Daglow et al. ..... 29/842

(Continued)

*Primary Examiner*—Michael C Zarroli
*Assistant Examiner*—Vladimir Imas
(74) *Attorney, Agent, or Firm*—Morris, Manning & Martin LLP; Tim Tingkang Xia

(57) ABSTRACT

A wire connector for connecting a printed circuit pad or line on a flat surface with an outlet wire. In one embodiment, the connector includes a connection member having a conductive member having a first end portion and a second end portion, and an insulting cover formed around the conductive member such that the first end portion and the second end portion of the conductive member are exposed outside the insulating cover, and a boot having a bottom portion, a top portion and a bowl-like body formed therebetween, where the bottom portion has a flat bottom surface, the top portion defines an opening, and the bowl-like body has a height defined the bottom portion and the top portion. As assembled, the insulting cover of the connection member is received and accommodated tightly by the opening of the boot such that the first and second end portions of the conductive member are respectively located outside and inside the boot.

11 Claims, 8 Drawing Sheets

U.S. PATENT DOCUMENTS 5,096,445 A * 3/1992 Lostumo ..... 439/865
5,137,478 A 8/1992 Graf et al.
5,364,292 A * 11/1994 Bethurum ..... 439/607.02
5,387,110 A * 2/1995 Kantner et al. ..... 439/59
5,559,307 A 9/1996 Whitehead et al.
5,573,429 A 11/1996 Miyazaki et al.
5,980,329 A * 11/1999 Klein et al. ..... 439/736
6,064,901 A * 5/2000 Cartmell et al. ..... 600/372
6,094,122 A * 7/2000 Sexton ..... 336/96
6,217,373 B1 * 4/2001 Johnston ..... 439/499
6,224,423 B1 * 5/2001 Yip et al. ..... 439/607.08
6,388,885 B1 * 5/2002 Alexander et al. ..... 361/760
6,582,252 B1 * 6/2003 Lin ..... 439/607.46
6,677,530 B2 1/2004 Blaha et al.
6,719,578 B1 * 4/2004 Klassen et al. ..... 439/289
6,851,962 B2 * 2/2005 McCormack, III ..... 439/276
7,351,369 B2 4/2008 King, Jr.
7,365,270 B2 4/2008 Michaud et al.
7,614,913 B2 * 11/2009 Ice ..... 439/607.05
2005/0287873 A1 * 12/2005 Carroll et al. ..... 439/676
2006/0160407 A1 * 7/2006 Carroll et al. ..... 439/418
2006/0180335 A1 * 8/2006 Cawood et al. ..... 174/74 R
2008/0164934 A1 * 7/2008 Hankey et al. ..... 327/407
2008/0166907 A1 * 7/2008 Sanford et al. ..... 439/345
2009/0170380 A1 * 7/2009 Lyon ..... 439/874

* cited by examiner

70

CONNECTOR FOR CONNECTING PRINTED SURFACE AREA OR LINE WITH CONDUCTIVE WIRE

FIELD OF THE INVENTION

This invention generally relates to a wire connector, and particularly to a conductive wire connector for connecting a printed conductive surface area and/or line with a conductive wire.

BACKGROUND OF THE INVENTION

All existing wire connectors and connection methods are limited to connect/bind two conductive wires. Among the most popular wire connectors, there are cap-shaped wire connectors, ceramic wire connectors, or simply insulating electrical tapes. However, no connecting device suitable for connecting one conducting area/line printed/formed on a flat surface with a regular conductive wire is available. An example of the conducting area/line is the outlet pads of an automobile's rear window defogger which disconnect to the outlet wire suppose to connect it to a power supply on an automobile.

Welding the wire to the isolated conducting surface can be done, however, it takes more tedious tools, time, and may cause damage to the surrounding area, e.g., a glass may not resist the heat involved in welding. Although under certain circumstance, conducting glue may be used between the wire and the conducting surface, however in certain cases, the contact area may be too small so that the biding may not be strong enough and long lasting, and also the glue between the two metals may introduce additional resistance, i.e., current drop which may cause local heating or conductivity reduction of the printed circuit.

Therefore, a heretofore unaddressed need exists in the art to address the aforementioned deficiencies and inadequacies.

SUMMARY OF THE INVENTION

In one aspect, the present invention relates to a wire connector for connecting a printed circuit pad or line on a flat surface with an outlet wire. In one embodiment, the connector includes a connection member having a conductive member having a first end portion and a second end portion, and an insulting cover formed around the conductive member such that the first end portion and the second end portion of the conductive member are exposed outside the insulating cover, and a boot having a bottom portion, a top portion and a bowl-like body formed therebetween, where the bottom portion has a flat bottom surface, the top portion defines an opening, and the bowl-like body has a height defined the bottom portion and the top portion. As assembled, the insulting cover of the connection member is received and accommodated tightly by the opening of the boot such that the first and second end portions of the conductive member are respectively located outside and inside the boot, and the connection member has a portion inside the boot that is longer than the height of the bowl-like body.

In one embodiment, the boot further comprises a flange extending radially from the bottom surface of the boot.

In another embodiment, the boot also comprises one or more mounting holes formed on the edge of the bottom portion of the boot.

In yet another embodiment, the boot further comprises a layer of glue formed on the bottom surface of the boot, and a thin film detachably attached onto the layer of glue for protection.

The boot is made of an elastic and insulating material.

The first end portion of the conductive member is adapted for connecting to the outlet wire, and the second end portion of the conductive member is adapted for connecting to the printed circuit pad or line. The conductive member comprises a single conductive wire or a bundle of conductive wires.

In one embodiment, the first end portion of the conductive member comprises a zigzag blade formed of a conductive material.

In another embodiment, the first end portion of the conductive member comprises a column formed of a conductive material.

In yet another embodiment, the first end portion of the conductive member comprises a spring with a contact tip formed of a conductive material. In one embodiment, the connector further includes a pair of hooks, where one of the pair of hooks is mounted on the top portion inside the boot and the other of the pair of hooks is mounted on the back side of the contact tip of the spring. In another embodiment, the connector also includes a bolt/screw made fully of partly by insulating material, and a bolt/screw hole defined in the top portion of the boot for receiving the bolt/screw, where the bolt/screw is adapted for applying a force on the contact tip of the spring so as to push the contact tip to tightly connect to the printed circuit pad or line.

These and other aspects of the present invention will become apparent from the following description of the preferred embodiment taken in conjunction with the following drawings, although variations and modifications therein may be effected without departing from the spirit and scope of the novel concepts of the disclosure.

DETAILED DESCRIPTION OF THE INVENTION

Figure 1:
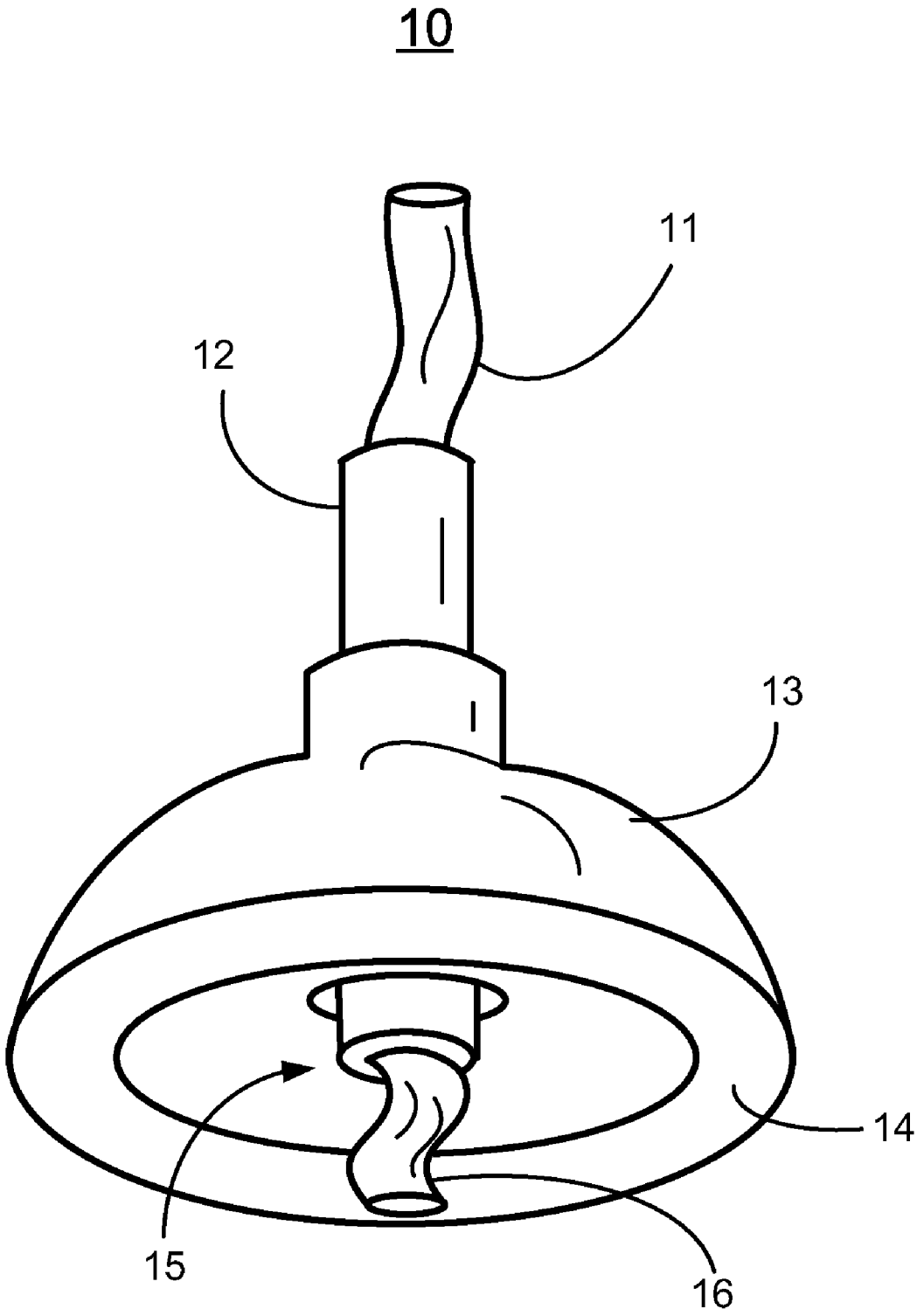
FIG. 1 shows a wire connector for connecting a conductive wire with a conducting area on a flat surface according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Note that titles or subtitles may be used in the examples for convenience of a reader, which in no way should limit the scope of the invention.

The description will be made as to the embodiments of the present invention in conjunction with the accompanying drawings in FIGS. 1-8. In accordance with the purposes of this invention, as embodied and broadly described herein, this invention, in one aspect, relates to an electrical connecting device for connecting a conductive wire to a flat conductive surface area on, normally, but not limited to, an insulating surface.

The wire connector in one embodiment is designed for quickly connecting a conductive wire with a conducting area on a flat surface. The key features include (1) quick, reliable, and easy usage, (2) using strong and insulating glue for holding it with the flat surface, and mainly using but not limited to the elastic force of the cover (when it is stretched) to guarantee the contact between its contact part and the area of interest on the surface, and (3) no use of special conducting glue or welding which are harder to use and may cause side effects for many applications.

The wire connector according to the embodiments of the invention typically includes, 1) as an electrical connector mainly for connecting a printed conducting area or line, therefore thin in conductor cross section, e.g., circuit board area/line on flat and normally insulating surface such as a circuit board or glass, 2) an outlet of a regular single wire or bundle of wires with insulator cover for further wire-to-wire connection using conventional wire connecting mechanism, 3) an elastic and insulating boot made by an elastic and insulating material such as rubber, with flat and ring shape bottom which may be self-adhesive or can be glued with strong, insulating, and fast drying glue (and can also be mounted with screws/bolts) to any flat surface, 4) making use of the elastic and insulating nature of the boot material, often making it slightly stretched in its normal working condition to cause a pulling force/tension to force the contact between the contact part in the boot and the area to be connected on the surface, and it does not conflict with welding and gluing the contact part in it to the area to be connected, 4) the contact part sits inside and in the middle of the boot, connected to the outlet wire on one end and to be connected (by elastic force of the boot) to the area of interest e.g., printed circuit pad on the surface, having various shapes such as natural wire, cylindrical, zigzag metal blade, or spring with flat tip etc., and in general is stretchable and compressable in certain range, and can be a bit longer in normal condition than the relaxed height of the boot.

In using an embodiment of the invention for example, user can push the connector towards the surface centered by the area to be connected on the surface when the bottom of the boot has glue, making the contact part right against the area to be connected on the surface, hold the connector for a short period of time to let the strong, insulating, and fast drying glue on the bottom of the boot to dry and taking effect, then release the boot/connect. Since the contact part inside the boot is longer than the boot height, the elastic boot is stretched, and as a result constantly has a force pushing the contact part against the area to be connected. The last step is to connect the outlet wire with a wire connected to the outside, e.g., a power supply using conventional wire connector or even electrical insulating tape.

In various embodiments, typically spring or spring-like contact part such as zigzag metal blade is used.

In one embodiment, a pair of hooks, one inside the boot mounted on top, and one on the back of the flat tip of the contact part with longer arm, can work together. They can hold with each other. A user can push/compress the spring on the contact part so that the hook on the back of the flat tip of the contact part can more up to reach the hook on top. User can first mount the connector boot on the surface with the area of interest centered, wait the glue on the boot bottom to dry without a need to hold the boot, then slightly twist/rotate the elastic boot to release the hooking inside, and then the spring on the contact part will take effect to push the contact part against the area to be connected (area of interest).

In another embodiment, an additional bolt/screw form the connect top to the contact area to apply force to the contact part, it also extend boot's height and cause a tension pushing the contact part against the area to be connected.

Referring to FIG. 1, one embodiment of the wire connector 10 is shown according to the present invention. The connector 10 has an outlet conducting wire 11 for further connecting the connector 10 with a wire using conventional wire-to-wire connection mechanism, a boot 13 made of an elastic, insulating and yet water proof material with a flat bottom surface 14 adhesive with strong, insulating, and fast drying glue on it for binding it to the flat surface on which a conductive area is located in the center, and a contact part 15 with a contact end 16 made of a conducting material and can be in various shapes.

The outlet wire 11 is corresponding to one of the regular wires, with an insulating cover 12 around the outlet wire 11. The outlet wire 11 can be a single wire or a bundle of wires. The outlet wire 11 is used to connect the wire connector 10, when mounted, to a wire outside, using one of conventional wire-to-wire mechanisms, such as a cap-shaped twister.

The boot 13 is made of an elastic material such as rubber, and is also water proof though water proofing is not the main feature or need of the art. The boot 13 has a flat, smooth, and ring-shape bottom, which can, but not necessarily, be self-adhesive, and can work with strong, insulating, fast-drying, and long lasting glue on it. In order to make it easy to use, according to some embodiments of the present invention, the glue should be fast-drying glue. In one embodiment, the user needs to hold the boot 13 for a while to allow the glue to dry and take effect. However, in certain embodiments of the invention associated with more advanced designs using hooks inside the boot or bolt/screw going through the boot against the contact part, it does not require the glue to dry fast, since the user can glue/mount the connect on an interested surface, wait till the glue to dry and take effect, then set it up to a proper working condition.

The inside contact part 15 is slightly longer than the height of the boot 13, so that when the connector 10 is glued onto a flat surface, it is stretched slightly and yielding a pulling force that pushes the contact part 15 connected against the conduct area on the flat surface. In this embodiment, the contact part 15 has certain thickness and hardness so that it will not be too small and soft to cause the elastic boot 13 un-stretched/released, i.e., lost pulling tension form the boot 13, thereby losing the contact between the contact part 16 and the conducting area of interest.

Figure 2:
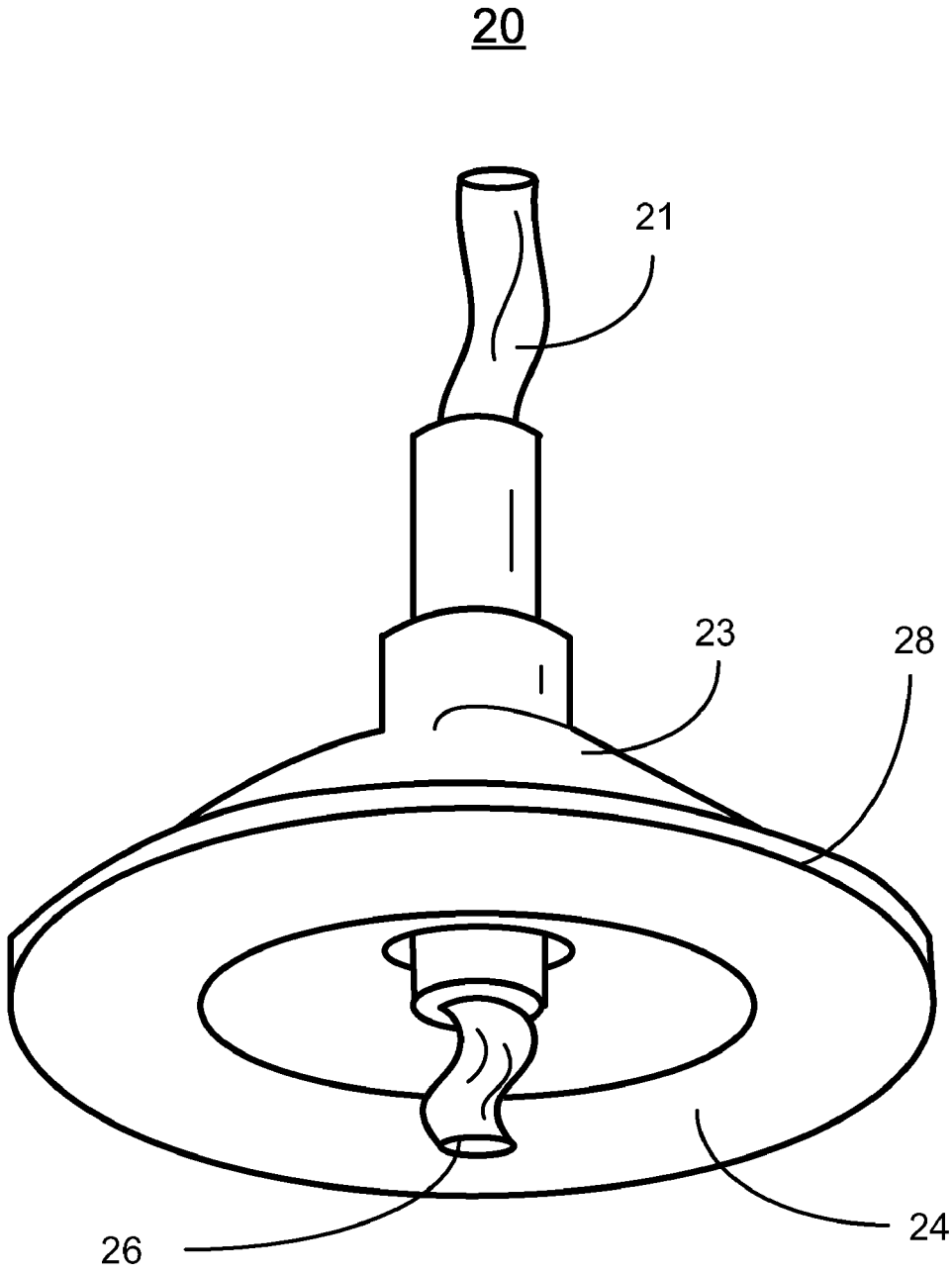
FIG. 2 shows a wire connector with a wider bottom of the boot according to another embodiment of the present invention.

FIG. 2 shows a connector 20 according to another embodiment of the present invention. Similar to the connector 10 shown in FIG. 1, the connector 20 has an outlet conducting wire 21 adapted for connecting the connector 20 with a wire using conventional wire-to-wire connection mechanism, a bowl-like boot 23 having a flat bottom surface 24, and a contact part with a contact end 26. Additionally, the bottom portion of the boot 23 has a flange 28 extending radially from the flat bottom surface 24 of the boot 23 so as to form more contact surface thereon.

Figure 3:
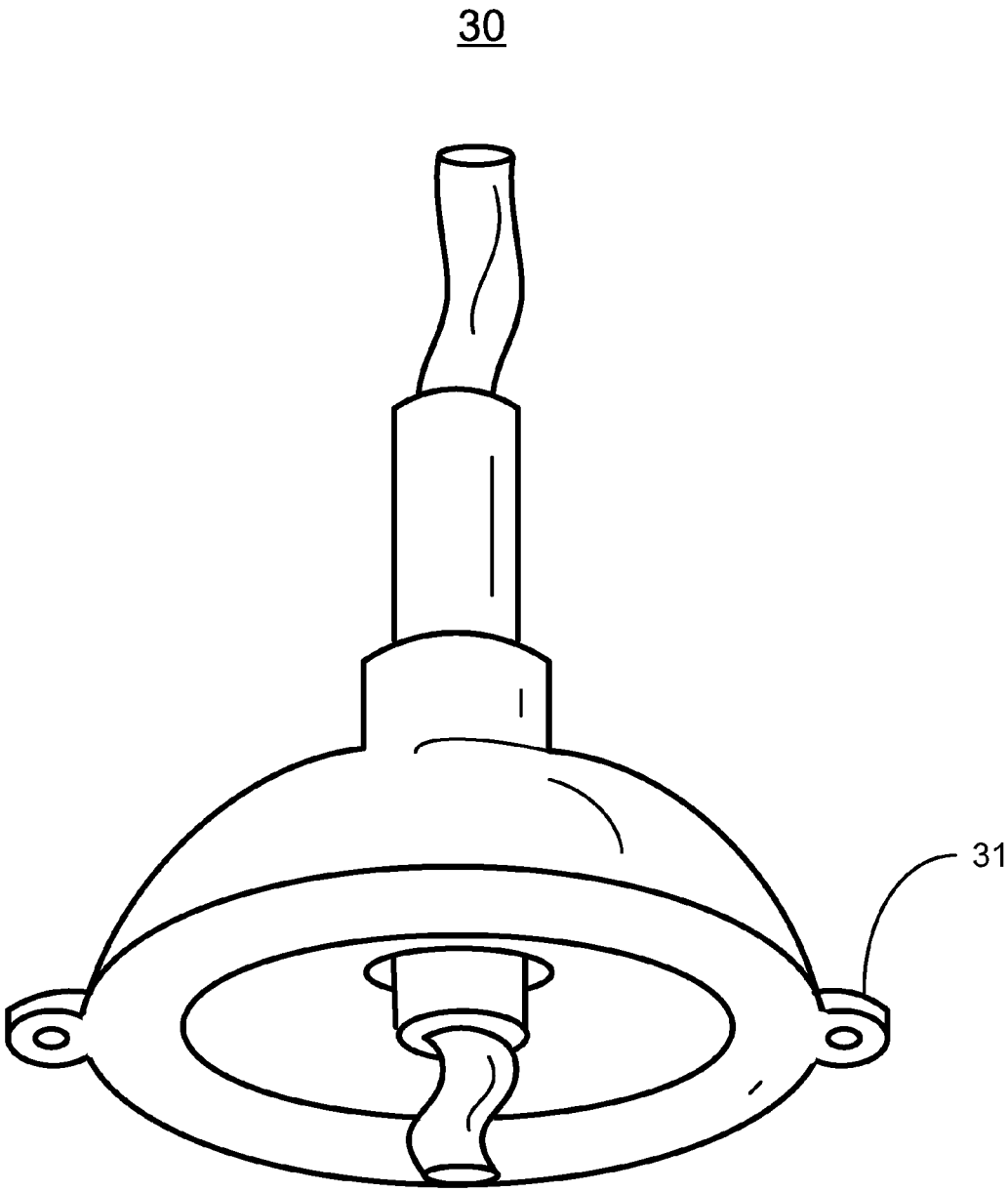
FIG. 3 shows a wire connector with screw mounting holes on its sides separately for fastening the wire connector onto a flat surface according to yet another embodiment of the present invention.

Referring to FIG. 3, a connector 30 is shown according to yet another embodiment of the present invention. Similar to the connector 10 shown in FIG. 1, the connector 30 has an outlet conducting wire adapted for connecting the connector 30 with a wire using conventional wire-to-wire connection mechanism, a bowl-like boot having a flat bottom surface, and a contact part with a contact end. Further, the connector 30 also has one or more mounting holes 31 formed on the edge of the bottom portion of the boot for being mounted with skews or bolts on an area to be connected. The inner surface of the mounting holes 31 can be threaded or flatted.

Figure 4:
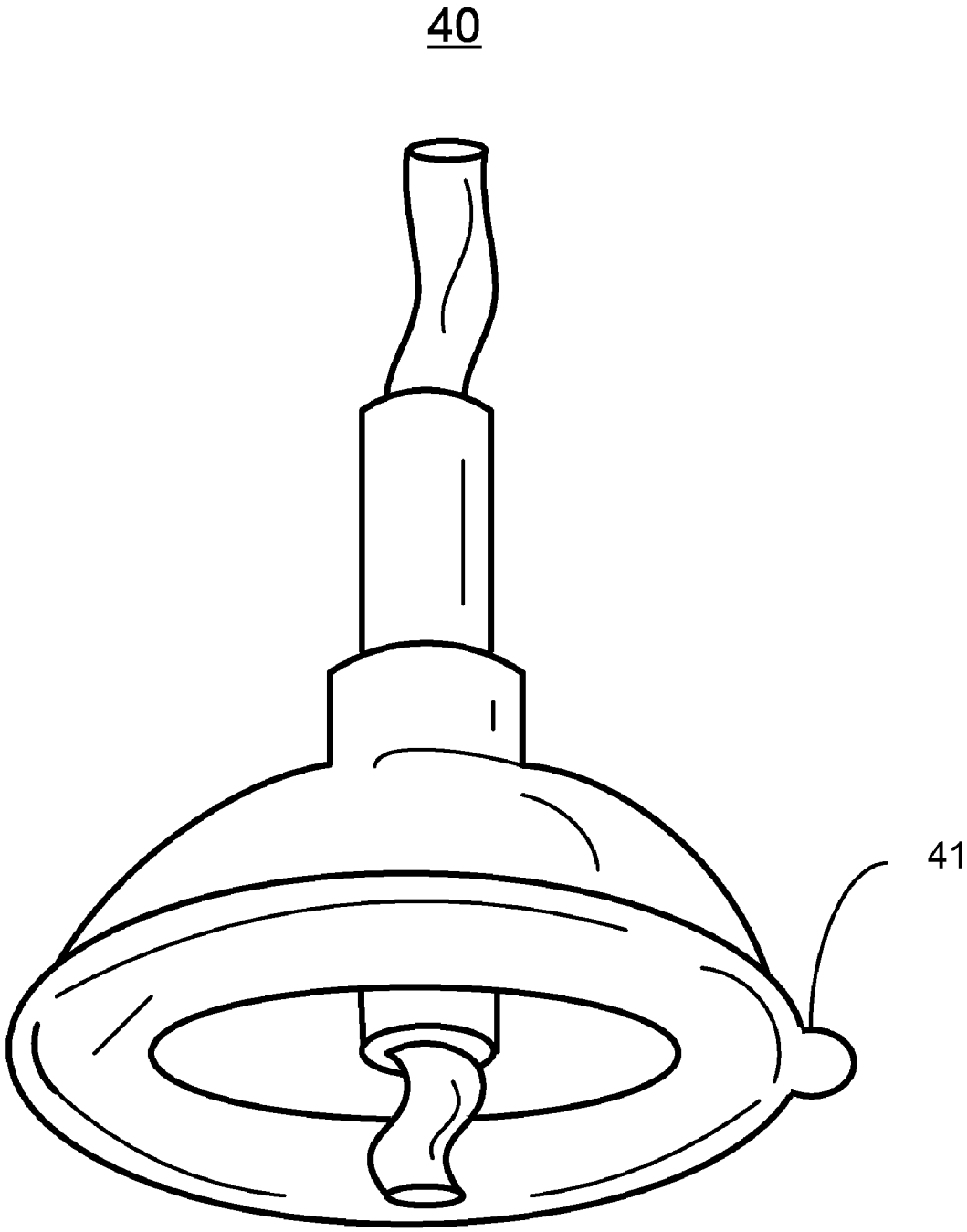
FIG. 4 shows a wire connector with a thin-film cover for its bottom self adhesive surface according to an alternative embodiment of the present invention. The cover is removable easily before use.

Referring to FIG. 4, a connector 40 is shown according to one embodiment of the present invention. Similar to the connector 10 shown in FIG. 1, the connector 40 has an outlet conducting wire adapted for connecting the connector 40 with a wire using conventional wire-to-wire connection mechanism, a boot having a flat bottom surface, and a contact part with a contact end. Furthermore, the bottom surface of the boot is formed to be self-adhesive, i.e., the bottom surface of the boot contains a layer of one or multiple types of glues that are normally strong, insulating, long-lasting, and fast drying. The glue layer is covered by a thin film cover 41 for protecting the self-adhesive surface.

Without intent to limit the scope of the invention, an exemplary example for explaining the usage of the connector of the present invention is given below. Additionally, the exemplary example is corresponding to the embodiment of the connector shown in FIG. 1, however, the principle and features of the usage disclosed below are also available to all other embodiments of the invention.

Figure 5:
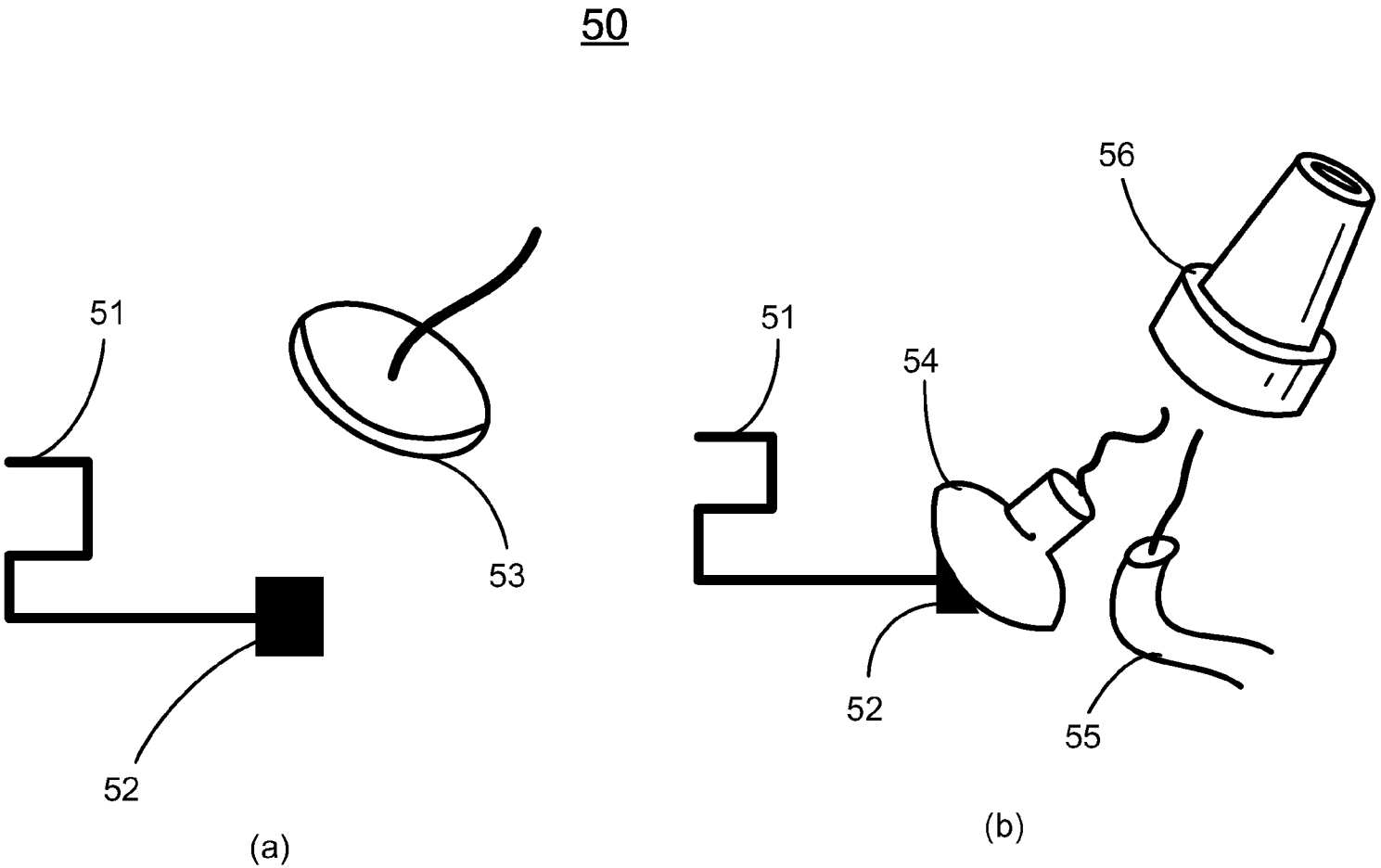
FIGS. 5(*a*) and 5(*b*) show the usage of a connector for connecting a conductive pad of a printed circuit to a conductive wire, as a quick fix of a broken connection, according to one embodiment of the present invention.

As shown in FIG. 5(*a*), a connective pad 52 connected to a conductive circuit 51 is broken off from its outlet connector 53. Instead of welding or gluing the outlet connector 53 with the pad 52 together, which may not be possible or favorable for various or whatever reasons, one can quickly apply an embodiment of the invented connector 54 to connect the circuit 51 to the outlet wire 55, and then to complete the connection a conventional wire-to-wire connector 56 or even electrical insulating tape, as shown in FIG. 5(*b*). This is corresponding to the situation of broken connection of defogger on an automobile rear window, for example.

Figure 6:
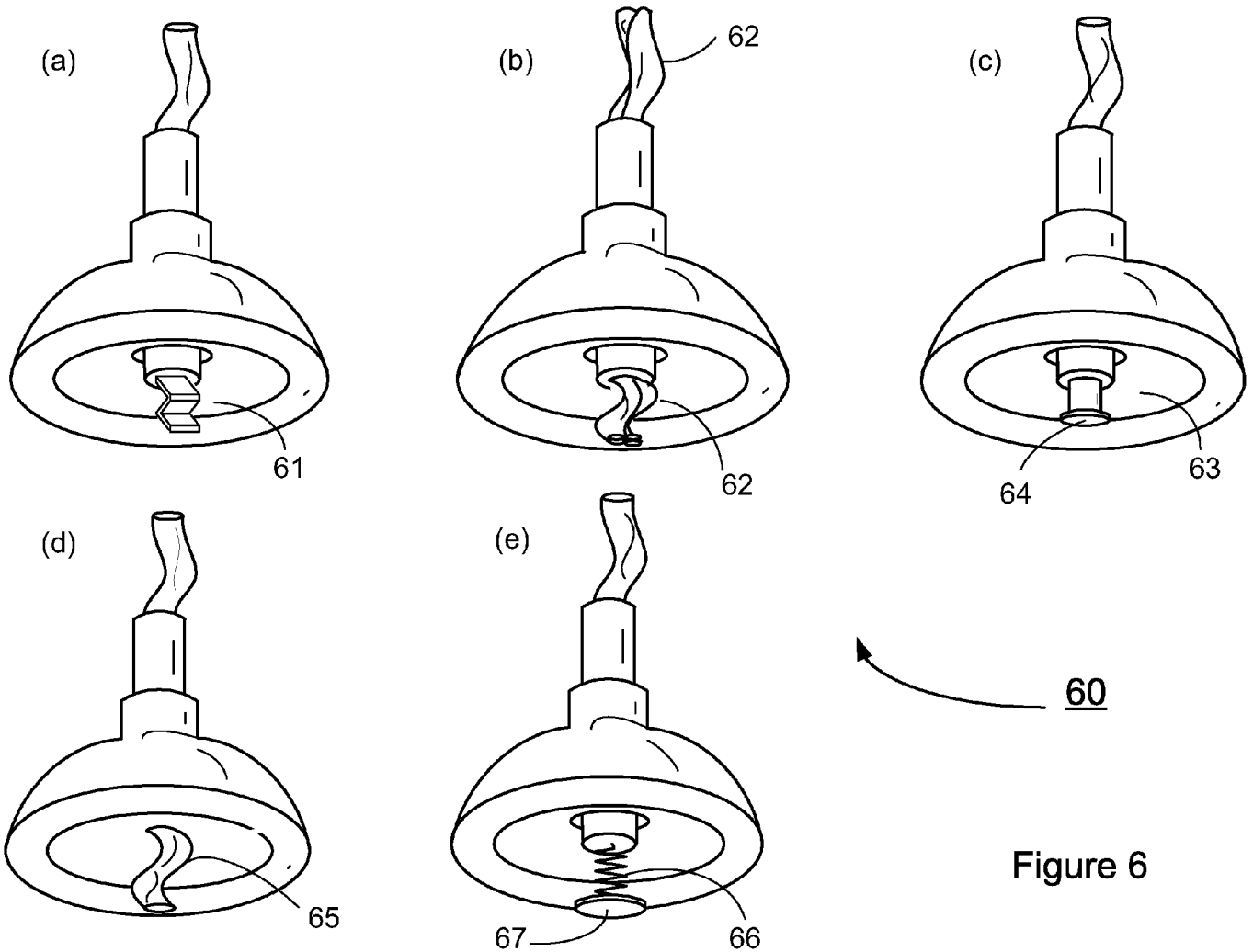
FIGS. 6(*a*)-6(*e*) show wire connectors according to different embodiments of the present invention, with various contact parts using a zigzag metal blade, multi wires, cylinder with flat and larger tip area, single wire with different interior design, and spring with flat and larger tip area.

Referring to FIGS. 6(*a*)-6(*e*), different embodiments of the connector 60 are shown according to the invention. Similar to the connector 10 shown in FIG. 1, the connector 60 has an outlet conducting wire adapted for connecting the connector 60 with a wire using conventional wire-to-wire connection mechanism, an elastic boot having a flat bottom surface, and a contact part with a contact end formed inside the boot. The contact part is longer than the boot height. FIG. 6(*a*) shows an embodiment of the connector 60 with a zigzag shape blade 61 as the contact part, which can be slightly compressed by force and recovered upon releasing the force, i.e., functioning similarly to a spring. FIG. 6(*b*) shows an embodiment of the connector 60 with multiple thin wires in a bundle as in the contact part, and for the outlet wire as well. FIG. 6(*c*) shows an embodiment of the connector 60 with a cylindrical contact part with a flat tip which can improve the contact area between the contact part and the contact area (area of interest) on the flat surface. FIG. 6(*d*) shows an embodiment of the connector 60 with slightly different contact part 65 in connection to the inside of the boot. FIG. 6(*e*) shows an embodiment of the connector 60 with a spring contact part and a flat tip on the spring providing larger contact area between the contact part and the contact area (area to be connected) on the flat surface. The spring can be made with a conductive metal or any elastic material and in that case, since the best elastic materials for spring may not be the best conductors, a separate wire may be needed to go through the boot, from the connector outlet wire to the contact part inside the boot.

For the connector according to the embodiments of the invention described above, a user needs to hold the connector for certain amount of time to allow the glue on the bottom surface of the boot to dry out and functioning. However, for the connector according to the embodiments of the invention disclosed below, there is no need to hold the connector during the connection.

Figure 7:
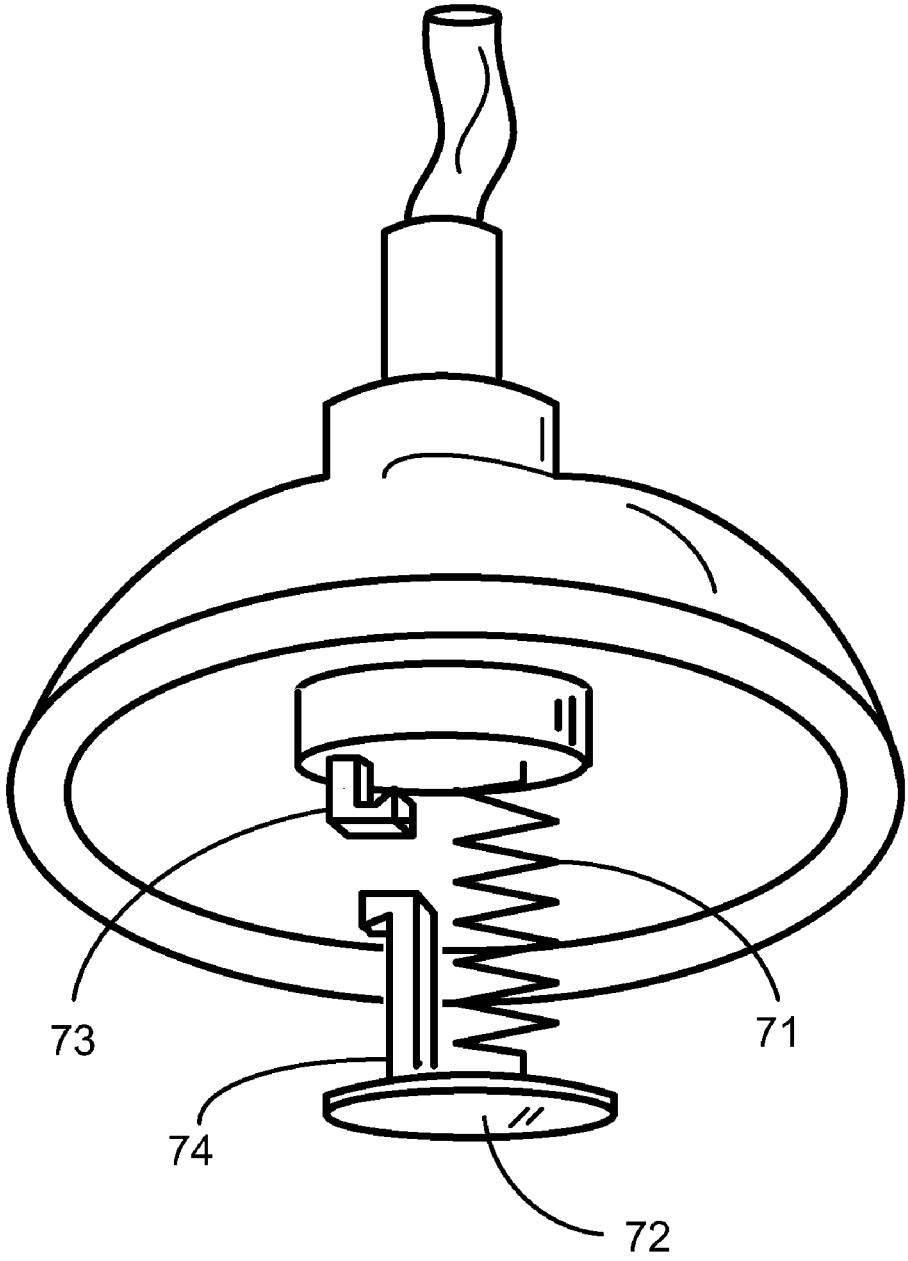
FIG. 7 shows a wire connector according to one embodiment of the present invention, with a pair of hooks inside the boot, one on top and one on the back of the flat tip of the connect part and with longer arms, a spring contact part in this case.

FIG. 7 shows a connector 70 according to one embodiment of the present invention. The connector 70 has a spring contact part 71 and a flat tip 72 connected to the spring contact part 71, which is similar to the connector, as shown in FIG. 6(*e*). The connector 70 has a pair of hooks 73 and 74, which is made by a insulating material such as plastic. The hook 74 is attached to the backside of the contact tip 72 and is longer than the other hook 73. At mounting time, a user can set the connector 70 up by pushing the spring part or any spring-like part such as zigzag metal blade, i.e., to compress the spring and make the pair of hooks 73 and 74 to hook/shake hand to each other. When the hooks 73 and 74 are set, the end of the contact tip 72 has the same length or short than the boot height, so that, at mounting time, the boot is not stretched and there is no pulling force formed it to apply on the contact part against the contact area (area to be connected) on the surface. As a result, the user does not need to hold the connect 70. When the glue, which shall always be strong, insulating, and easy-to-dry if possible, is dried up and fully functioning after certain amount of time, the user only needs to push the boot slightly and then twist/rotate it slightly to release the hooks from each other, then spring of the contact part now is uncompressed, and because the contact part is originally longer than the boot height, will take effect to push the flat time against the area to be connected and that makes the two in constant contact, and then intern, the outlet wire of the connector can be connected to the wire leading outside using conventional wire-to-wire connecting mechanism, e.g., a cap-shaped twister or simply electrical insulating tape.

Figure 8:
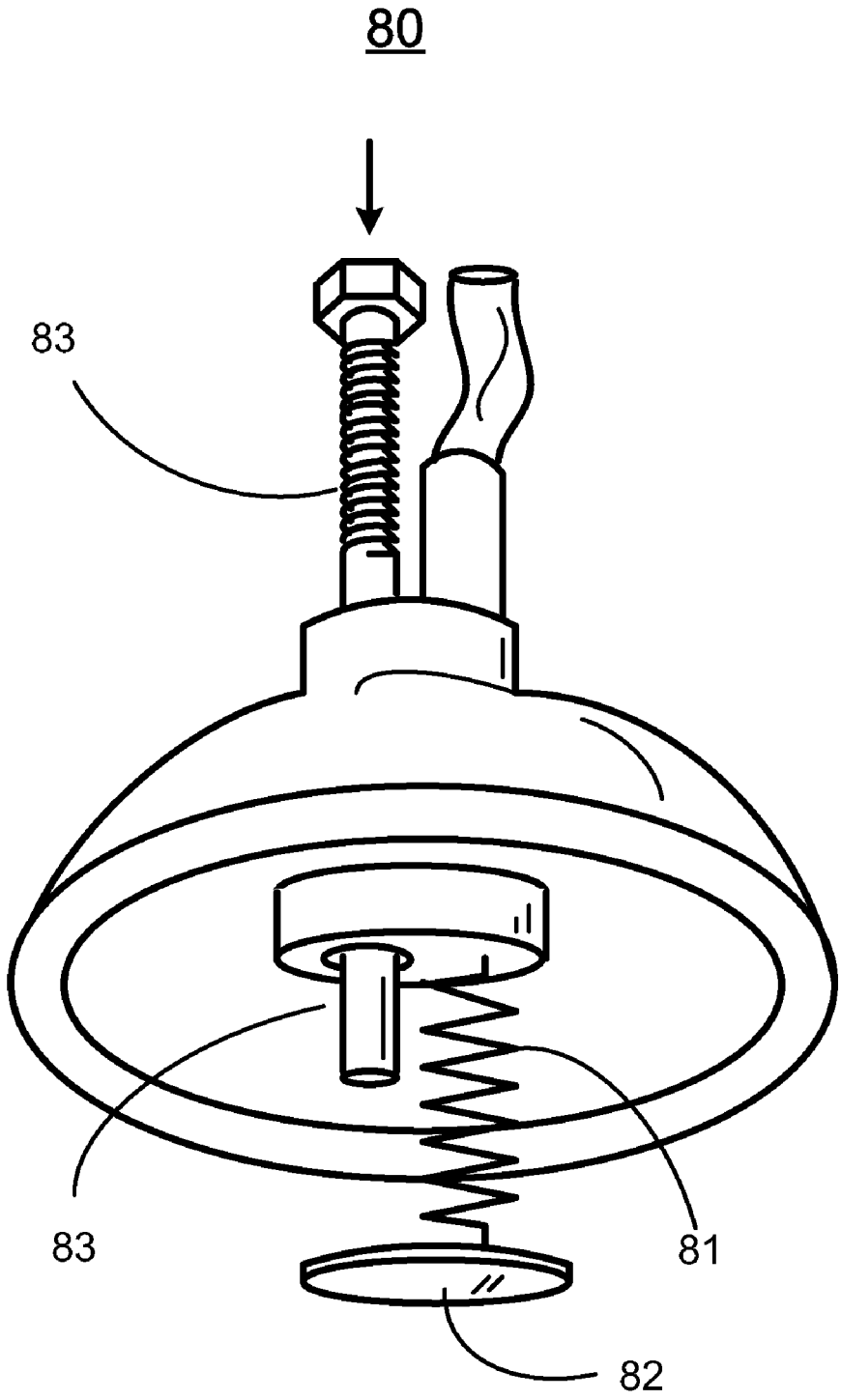
FIG. 8 shows a wire connector according to an embodiment of the present invention, with an insulating bolt/screw hole with interior threads which allows a bolt/screw to drive through it to push the flat tip of the contact part against the area to be connected.

Referring to FIG. 8, a connector 80 is shown according to another embodiment of the invention. The connector 80 has a bolt/skew 83 which is made of insulating material. The bolt/skew 83 can be skewed through a hole with matching threads (female part) on the top of the connector 80, and the bolt/skew 83 can go through the hole directly against the flat tip 82 of the contact part connected to a spring or spring-like contact part 81, such as zigzag metal blade. In this embodiment, the length of the original height of the contact part 81 is the same or less than the boot height, so the contact part does not stretch the elastic boot at mounting time. When the glue on the bottom of the boot is dried up and is functioning, then user can drive in the bolt/screw, which in tern pushes the contact flat tip against the area for connecting/binding.

In sum, the present invention, among other things, discloses a connecting device for quickly and tightly connecting/ binding a conductive wire with a contact area on a flat surface. The connecting device includes an outlet wire, an elastic and insulating boot with a flat bottom, and a flexible contact part in various shapes such as original wire(s), zigzag metal blade, or spring with a flat tip. The connecting device may also include one or more mounting screws, tightening bolt/screws, or a pair of hooks inside the boot.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A wire connector for connecting a printed circuit pad or line on a flat surface with an outlet wire comprising:

(a) a connection member having a conductive member having a first end portion and a second end portion, and an insulting cover formed around the conductive member such that the first end portion and the second end portion of the conductive member are exposed outside the insulating cover; and (b) a boot having a bottom portion, a top portion and a bowl-like body formed therebetween, wherein the bottom portion has a flat bottom surface, the top portion defines an opening, and the bowl-like body has a height defined the bottom portion and the top portion, wherein as assembled, the insulting cover of the connection member is received and accommodated tightly by the opening of the boot such that the first and second end portions of the conductive member are respectively located outside and inside the boot;

wherein the first end portion of the conductive member is adapted for connecting to the outlet wire, and the second end portion of the conductive member is adapted for connecting to the printed circuit pad or line; and wherein the first end portion of the conductive member comprises a zigzag blade formed of a conductive material.

2. The wire connector of claim 1, wherein as assembled, the connection member has a portion inside the boot that is longer than the height of the bowl-like body.

3. The wire connector of claim 1, wherein the boot further comprises a flange a flange extending radially from the bottom surface of the boot.

4. The wire connector of claim 1, wherein the boot further comprises one or more mounting holes formed on the edge of the bottom portion of the boot.

5. The wire connector of claim 1, wherein the boot further comprises a layer of glue formed on the bottom surface of the boot, and a thin film detachably attached onto the layer of glue for protection.

6. The wire connector of claim 1, wherein the boot is made of an elastic and insulating material.

7. The wire connector of claim 1, wherein the conductive member comprises a single conductive wire or a bundle of conductive wires.

8. The wire connector of claim 1, wherein the first end portion of the conductive member comprises a column formed of a conductive material.

9. A wire connector for connecting a printed circuit pad or line on a flat surface with an outlet wire, comprising:

(a) a connection member having a conductive member having a first end portion and a second end portion, and an insulting cover formed around the conductive member such that the first end portion and the second end portion of the conductive member are exposed outside the insulating cover; and (b) a boot having a bottom portion, a top portion and a bowl-like body formed therebetween, wherein the bottom portion has a flat bottom surface, the top portion defines an opening, and the bowl-like body has a height defined the bottom portion and the top portion, wherein as assembled, the insulting cover of the connection member is received and accommodated tightly by the opening of the boot such that the first and second end portions of the conductive member are respectively located outside and inside the boot;

wherein the first end portion of the conductive member is adapted for connecting to the outlet wire, and the second end portion of the conductive member is adapted for connecting to the printed circuit pad or line; and wherein the first end portion of the conductive member comprises a spring with a contact tip formed of a conductive material.

10. The wire connector of claim 9, further comprising a pair of hooks, wherein one of the pair of hooks is mounted on the top portion inside the boot and the other of the pair of hooks is mounted on the back side of the contact tip of the spring.

11. The wire connector of claim 9, further comprising a bolt/screw made of a insulating material completely or partly, and a bolt/screw hole defined in the top portion of the boot for receiving the bolt/screw, wherein the bolt/screw is adapted for applying a force on the contact tip of the spring that pushes the contact tip in tightly contact with the printed circuit pad or line.

* * * * *